United States Patent [19]

Oxborrow

[11] Patent Number: 4,626,234

[45] Date of Patent: Dec. 2, 1986

[54] TRAY-TYPE CARTONS ERECTING METHOD AND APPARATUS

[75] Inventor: Bernard H. Oxborrow, Swindon, England

[73] Assignee: Metal Box Public Limited Company, Reading, United Kingdom

[21] Appl. No.: 589,084

[22] PCT Filed: May 4, 1983

[86] PCT No.: PCT/GB83/00130

§ 371 Date: Jan. 4, 1984

§ 102(e) Date: Jan. 4, 1984

[87] PCT Pub. No.: WO83/04000

PCT Pub. Date: Nov. 24, 1983

[30] Foreign Application Priority Data

May 10, 1982 [GB] United Kingdom ..... 8213491

[51] Int. Cl.[4] ..... B31B 1/44

[52] U.S. Cl. ..... 493/167; 493/143; 493/134; 493/136; 493/176; 493/147; 493/182; 53/563

[58] Field of Search ..... 493/167, 133, 143, 137, 493/902, 79, 80, 134, 136, 141, 153, 176, 179, 399, 174; 53/563, 218

[56] References Cited

U.S. PATENT DOCUMENTS

| | | | |
|---|---|---|---|
| 2,863,370 | 12/1958 | Dorfman | 493/136 |
| 3,593,623 | 7/1970 | Oakley | 493/167 |
| 3,618,481 | 11/1971 | Odenhagen | 493/167 |
| 3,626,819 | 9/1969 | Hoyrup | 493/167 |
| 3,751,876 | 8/1973 | Oakley et al. | 493/134 |
| 4,028,999 | 6/1977 | Lee | 493/136 |
| 4,233,798 | 11/1980 | Helding | 53/76 |
| 4,295,839 | 10/1981 | Baker | 493/143 |
| 4,417,882 | 11/1983 | Wallin | 493/167 |

FOREIGN PATENT DOCUMENTS

| | | | |
|---|---|---|---|
| 222904 | 11/1958 | Australia | 493/167 |
| 0022139 | 1/1981 | European Pat. Off. . | |
| 1587981 | 10/1968 | France . | |
| 2035244 | 2/1970 | France . | |
| 2468459 | 10/1980 | France . | |

*Primary Examiner*—Francis S. Husar
*Assistant Examiner*—David B. Jones
*Attorney, Agent, or Firm*—Burns, Doane, Swecker & Mathis

[57] ABSTRACT

A rectangular tray-type carton formed from a blank of plastics-coated board has a peripheral flange for attachment of a closure lid. The flange is formed after the erection of the carton side wall in a punch and die arrangement, by folding down elongate panels carried along the free edges of the side wall and by subsequently joining the panels together at their ends by means of overlapping tabs which are heat-sealed together. In order to avoid damage to the tabs during formation of the side wall the uppermost tabs are folded out of the plane of the blank before it enters the punch and die arrangement.

12 Claims, 14 Drawing Figures

TRAY-TYPE CARTONS ERECTING METHOD AND APPARATUS

This invention relates to tray-type cartons, in particular such cartons which are generally rectangular and erected by folding from a flat blank of cardboard or other foldable sheet material and which, furthermore, have a peripheral flange on to which a closure lid for the carton may be attached, for example by heat-sealing of the lid margin to the free upper surface of the flange.

In the erection of rectangular tray-type cartons having peripheral flanges from flat blanks, it is known to form the flanges by the same operation as is used to fold up the side wall panels of the cartons in relation to the carton bases, and to secure those panels in their desired side wall forming relation by means of gusset folds formed from gusset panels which join the side wall panels integrally together; the gusset folds are secured against the side wall at, for example, the outside surface of the side wall panels at the ends of the carton. Such a method, however, has several disadvantages attendant upon the formation of the peripheral flanges, and it is an object of the present invention to provide an improved method and apparatus for erecting a carton as recited above, including the formation of the peripheral flange.

According to the invention from a first aspect, there is provided a method of erecting from a blank of foldable sheet material a rectangular tray-type carton having a base formed from a base panel of the blank, a side wall upstanding from the base and formed from four side wall panels, gusset folds secured against the side wall at the corners of the carton and formed from gusset panels by which the side wall panels are joined integrally together, and a continuous peripheral flange outturned from the side wall around the mouth of the carton, the flange being formed from elongate panels carried by the side wall panels and formed at their ends with tabs which are secured together in overlapping relation at the corners of the carton, the method comprising:

(a) folding up from the plane of the blank those of the tabs which are to be uppermost in the erected carton, (b) at a first station, forming the side wall by folding up the side wall panels in relation to the base panel whilst folding the gusset panels to form the gusset folds, such folding being accompanied by movement of the elongate panels with the side wall panels as coplanar extensions thereof with the exception of the said uppermost ones of the tabs, (c) moving the partially erected carton from the first station to a second station, (d) at the second station, folding the elongate panels outwardly in relation to the side wall and into generally coplanar relation with one another, with the said uppermost tabs overlying other ones of the tabs at the corners of the carton, and (e) securing the overlapping tabs together at the corners of the carton to form the continuous peripheral flange.

In accordance with the invention from a second aspect there is provided an apparatus for performing the method defined in the previous paragraph and comprising:

(a) a first station incorporating pivotal fingers arranged to be operated to fold up from the plane of the blank those of the tabs which are to be uppermost in the erected carton, and a punch and die arranged to form the side wall by folding up the side wall panels in relation to the base panel whilst folding the gusset panels to form the gusset folds, such folding being accompanied by movement of the elongate panels with the side wall panels as coplanar extensions thereof with the exception of the said uppermost ones of the tabs, (b) a conveyor arranged to receive the partially erected carton from the first station and to transport it to a second and third stations, (c) folding means at the second station for folding the elongate panels outwardly in relation to the side wall so as to form the peripheral flange and to bring the tabs into overlapping relationship at the corners of the carton, and (d) sealing means at the third station for bonding the overlapping tabs together to complete the peripheral flange.

Preferably the pivotal fingers are arranged to be operated by a cam mechanism associated with the punch. The conveyor may be intermittently driven to index the cartons through the second and third stations. Preferably the folding means is in two parts arranged to operate sequentially, first on the leading and trailing edges and then on the sides of the carton. The folding means may comprise a vertically reciprocable actuating assembly carrying spring-mounted former members to effect a first folding and vertical pins movable through apertures in the former members to effect a further folding of the elongate panels.

The sealing means at the third station preferably comprise a vertically reciprocable clamping assembly having spring-mounted posts to apply vertical pressure to the pairs of tabs and nozzles for directing hot air on to the tabs before they are pressed together by the posts.

An embodiment of the invention will now be described by way of example and with reference to the accompanying diagrammatic drawings. In the drawings.

Figure 1:
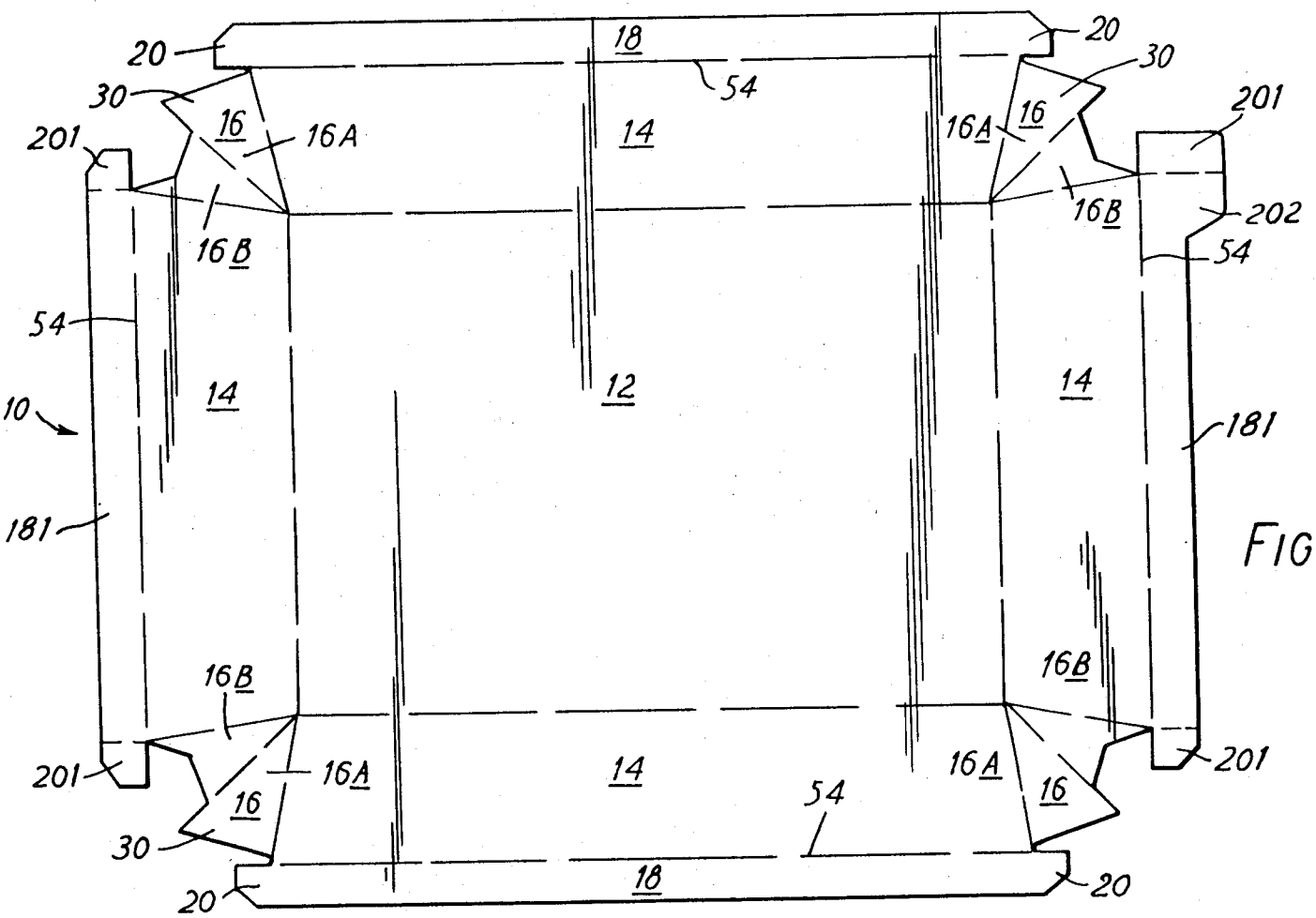
FIG. 1 shows a carton blank for erection to form a tray-type carton having a peripheral flange.
Figure 2:
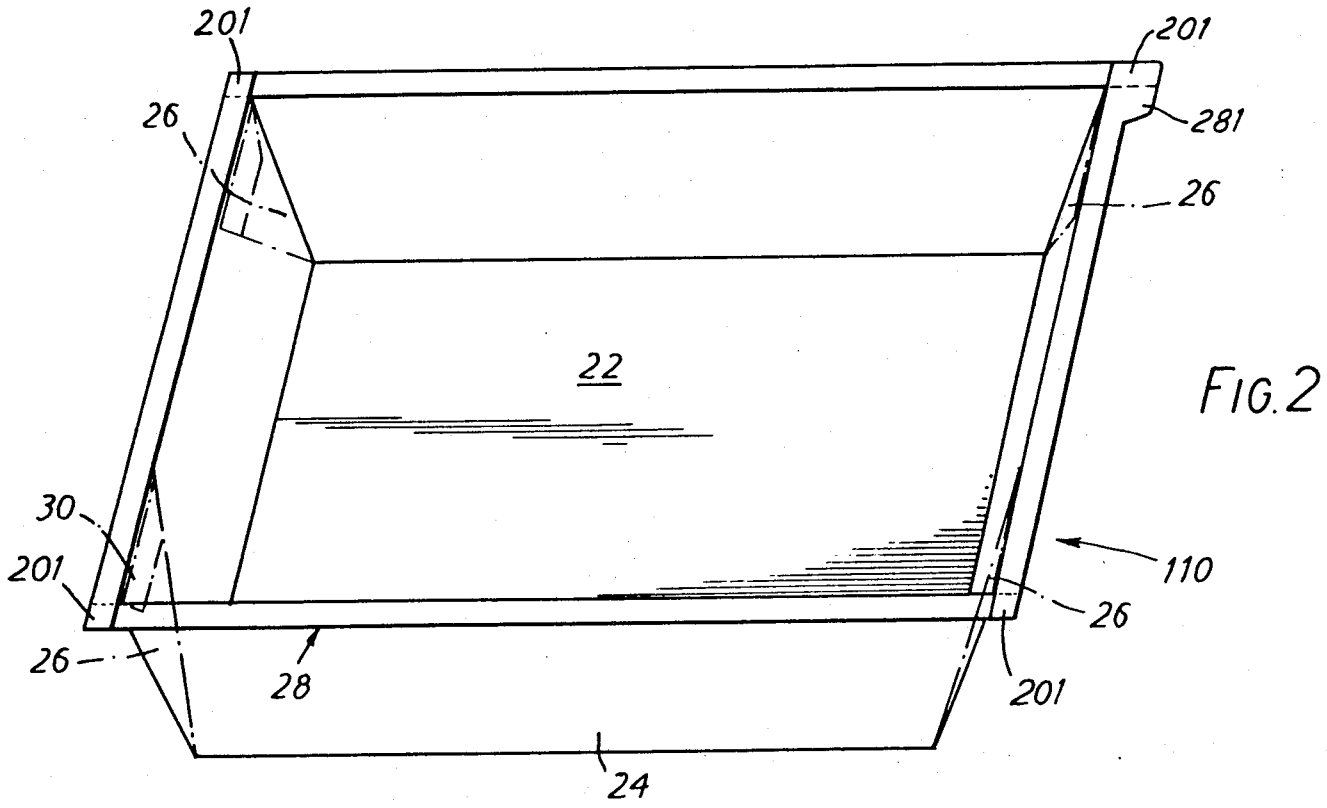
FIG. 2 shows the carton erected from the blank of FIG. 1.
Figure 3:
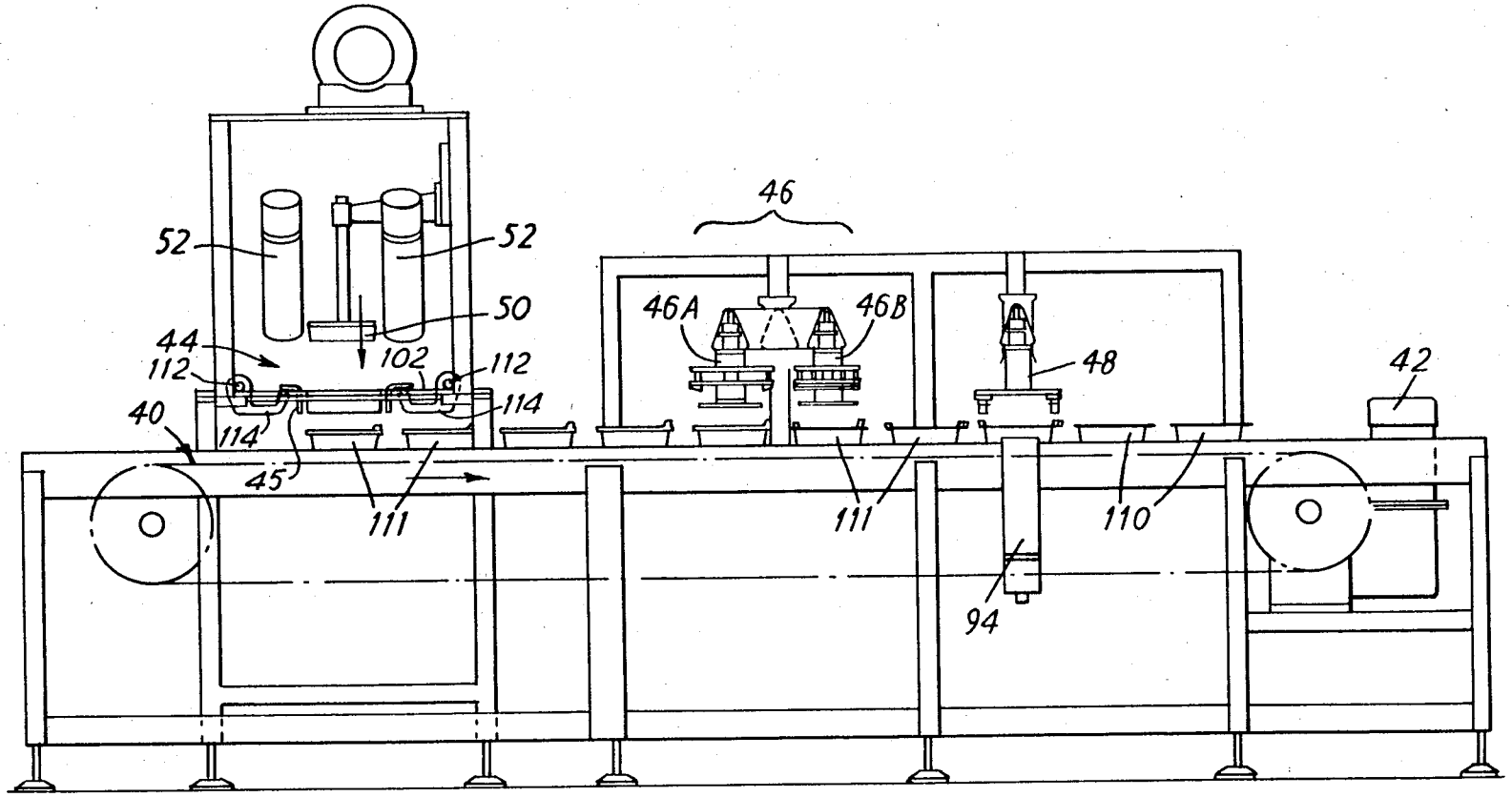
Figure 4:
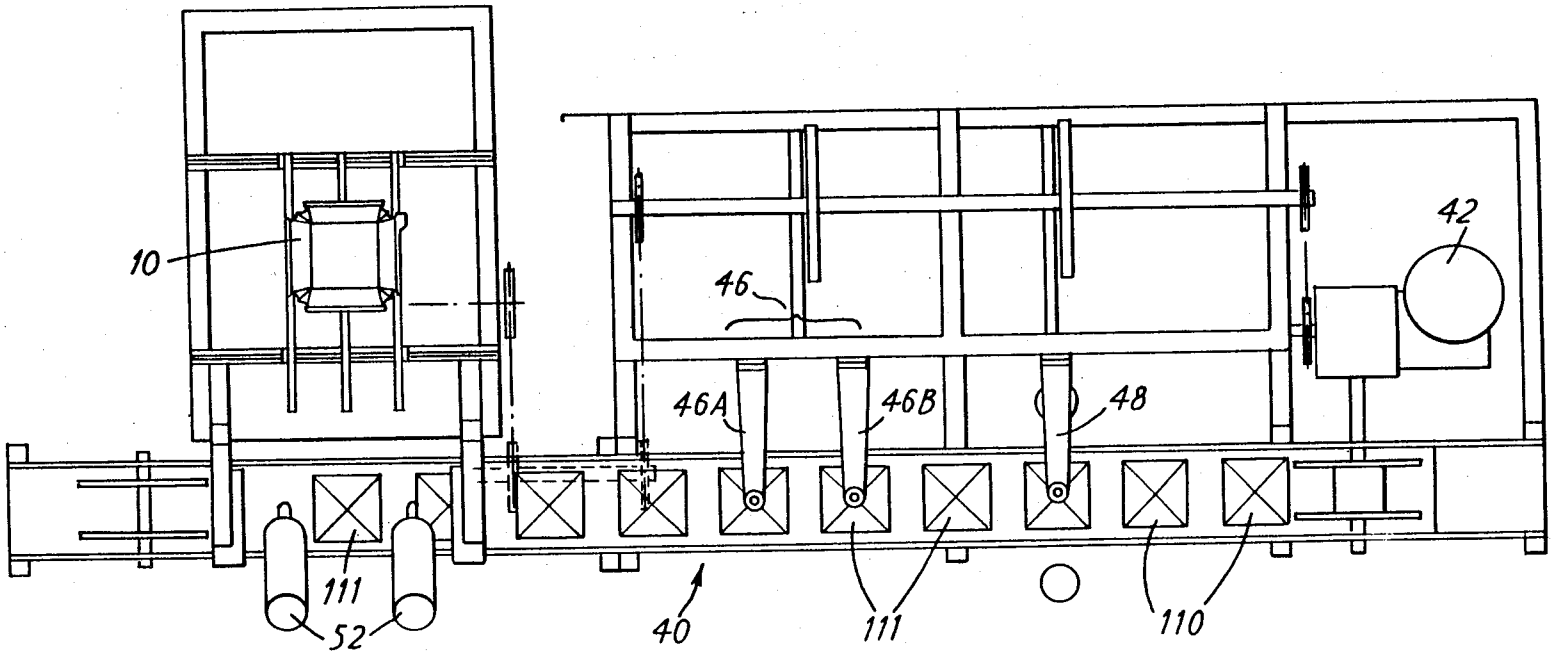
Figure 5:
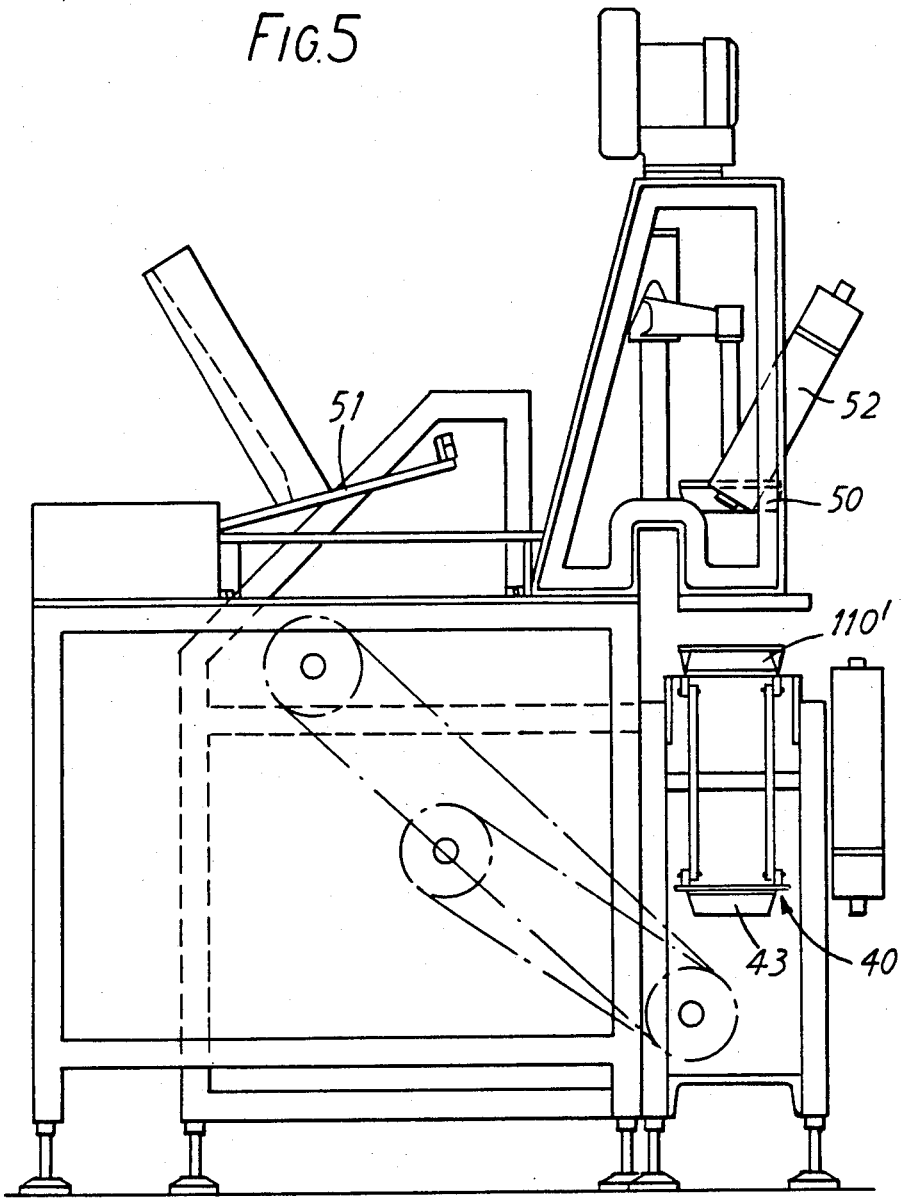
Figure 6A:
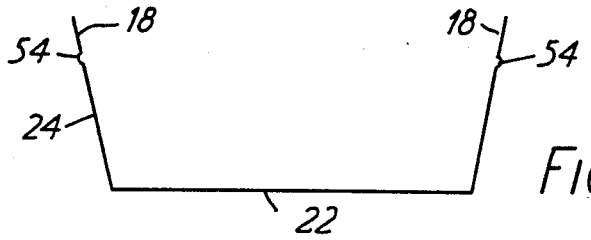
Figure 6B:
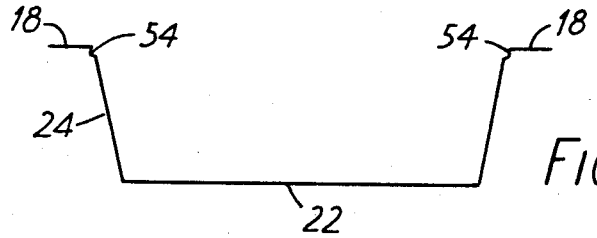
Figure 6C:
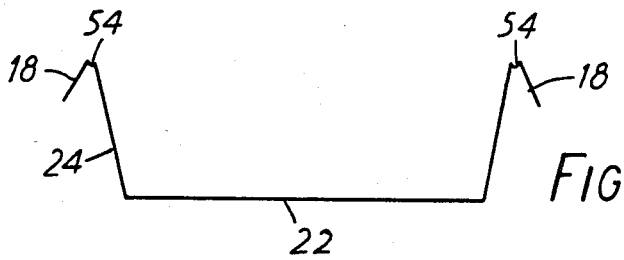
Figure 6D:
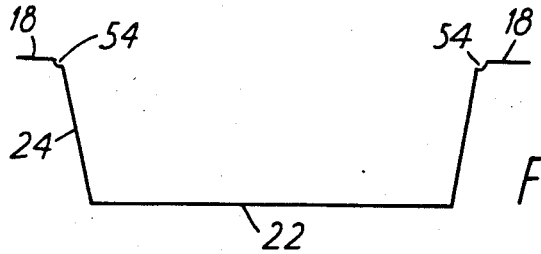
Figure 7:
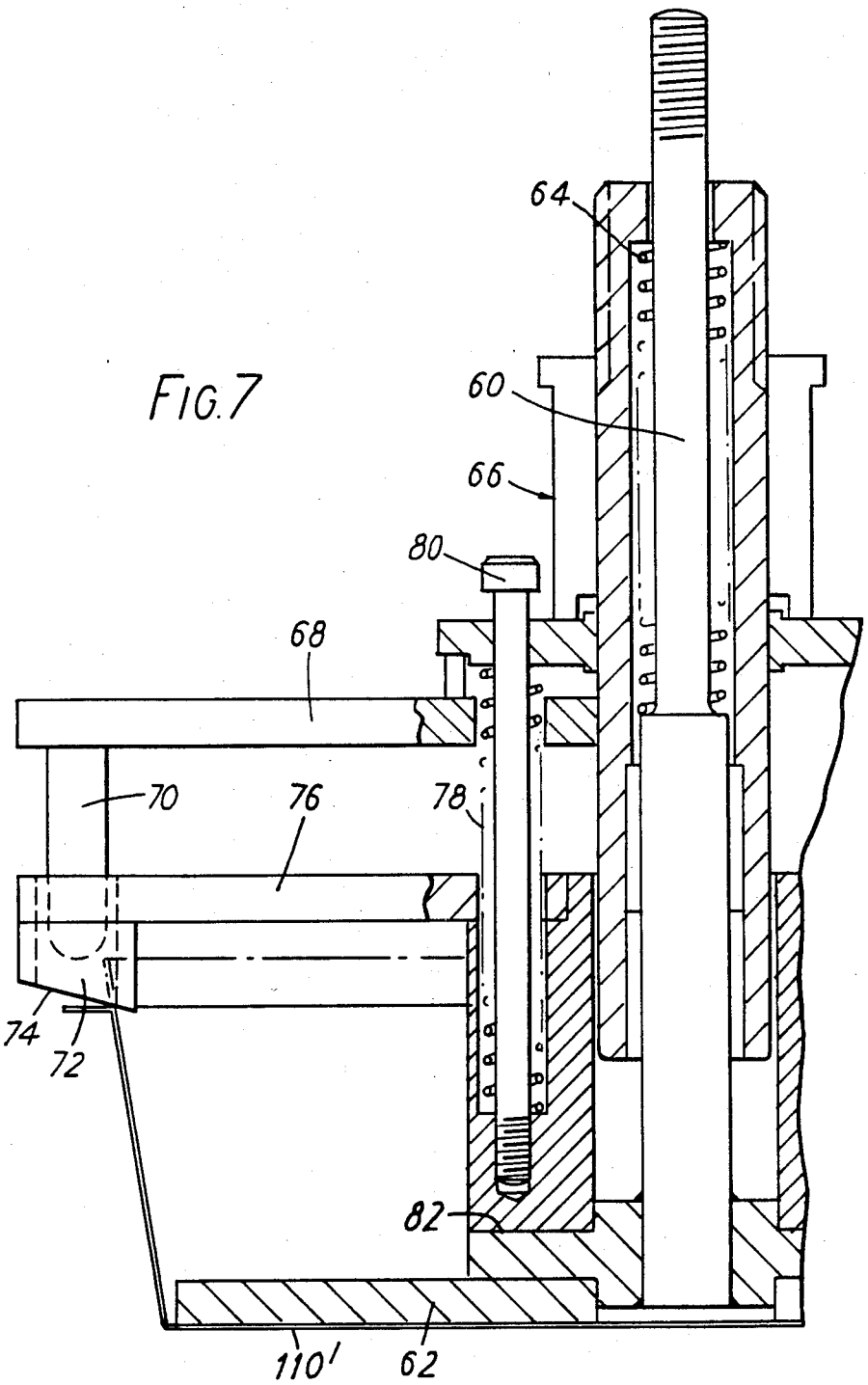
Figure 8:
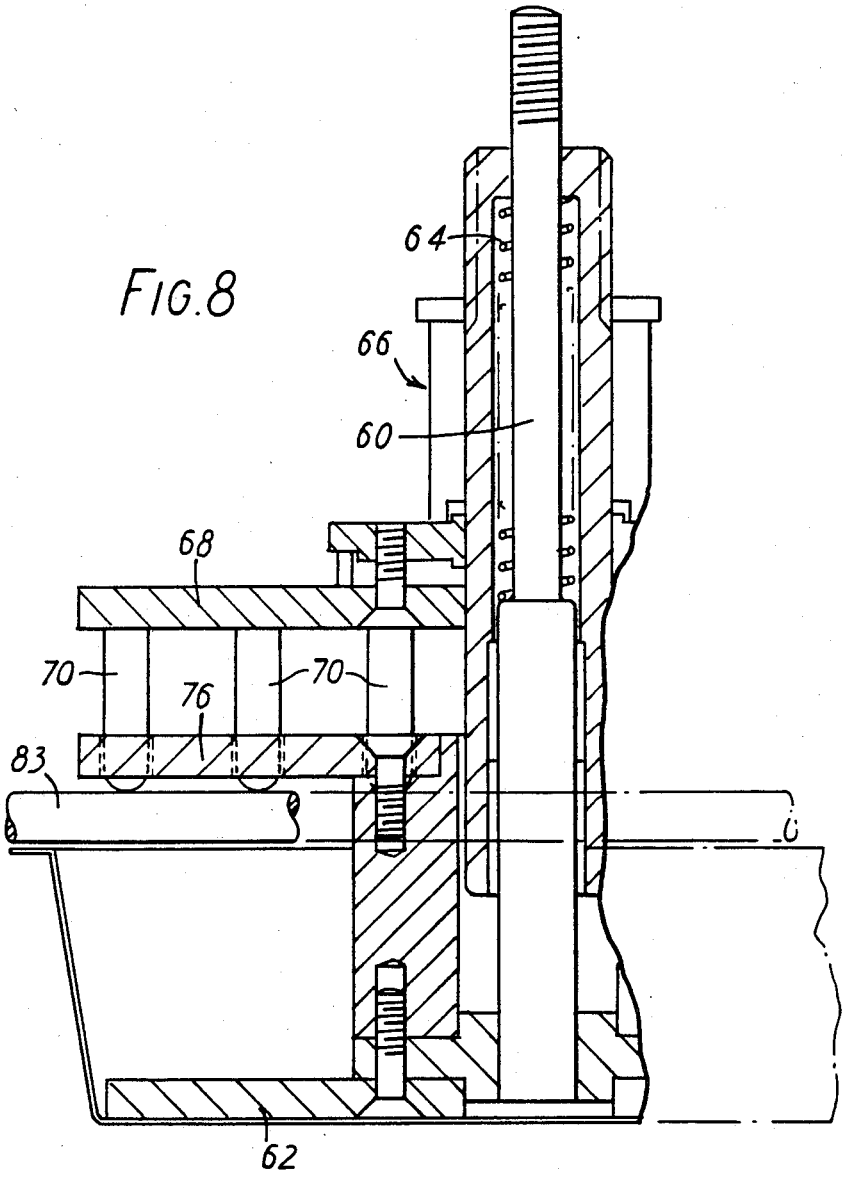
Figure 9:
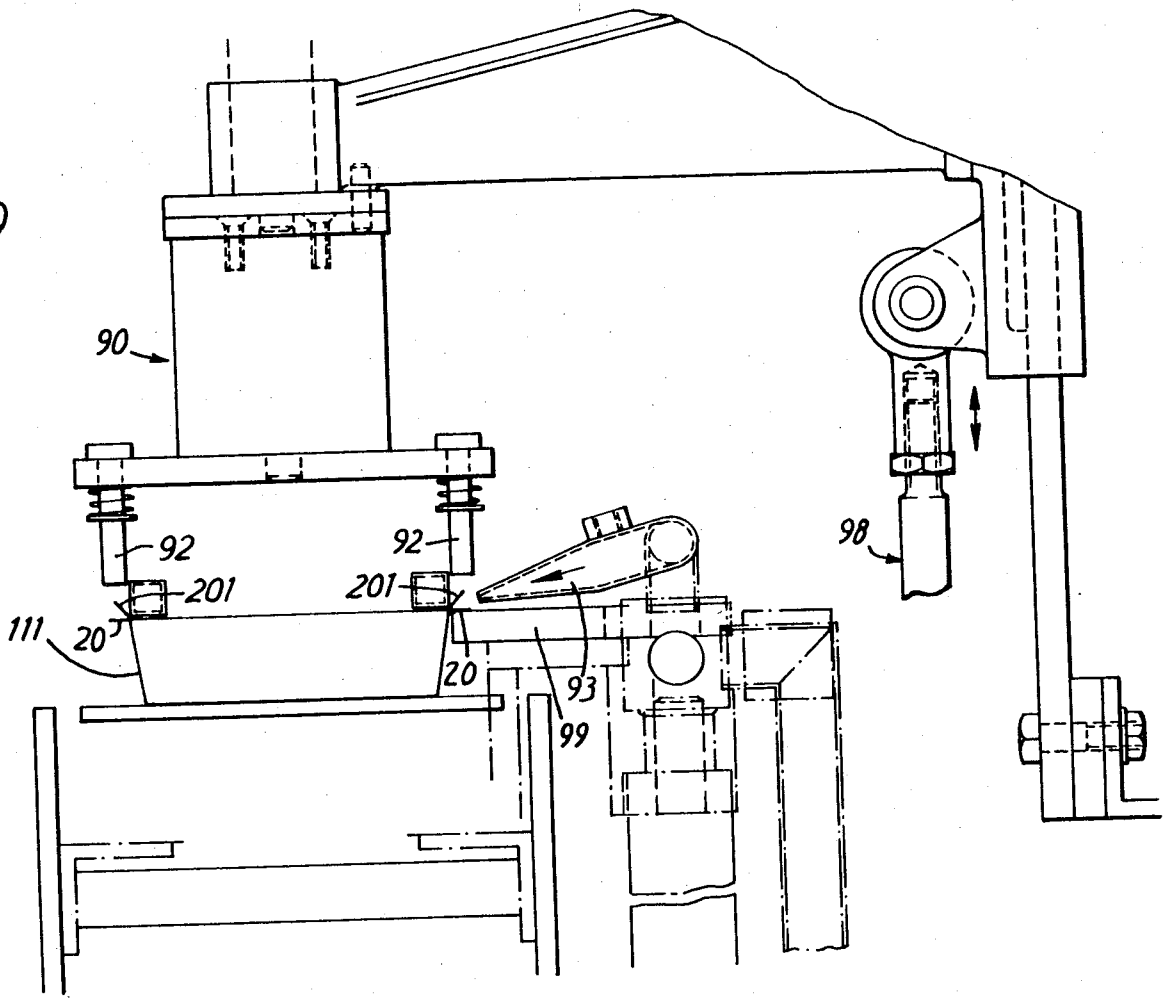
Figure 10:
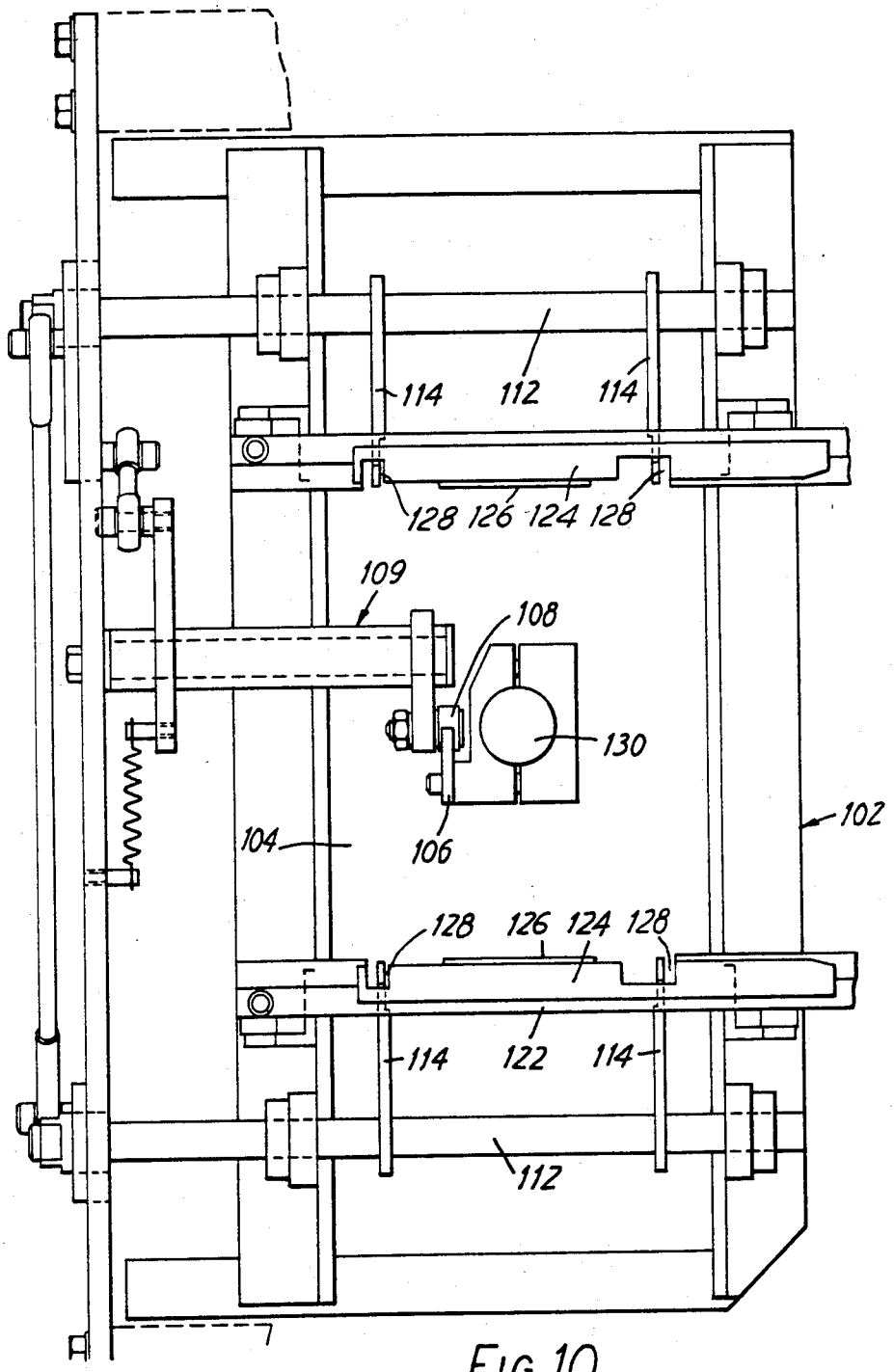
Figure 11:
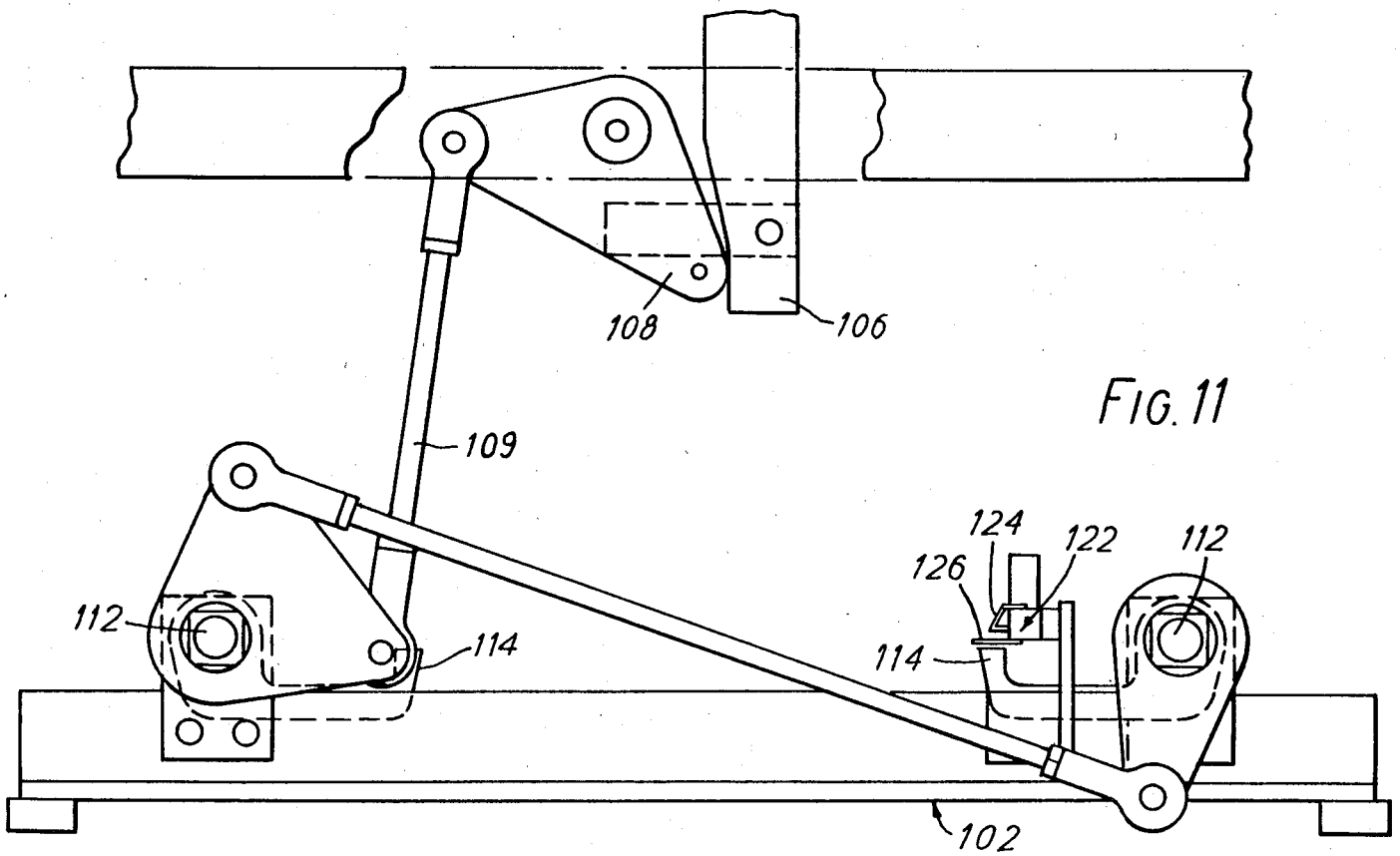

FIG. 3 diagrammatically shows in side elevation an apparatus for erecting the blank of FIG. 1 to form the carton of FIG. 2, FIG. 4 diagrammatically shows the apparatus of FIG. 3 in plan view, FIG. 5 diagrammatically shows the apparatus of FIG. 3 in end elevation as seen looking downstream of the carton path, FIGS. 6A, 6B, 6C and 6D are simplified cross-sectional views of the carton at various stages of the formation of the peripheral flange by the apparatus of FIGS. 3 to 5, FIG. 7 shows in side elevation and to an enlarged scale, one half only of the part of the apparatus of FIGS. 3 to 5 which effects the folding down of the peripheral flange along the ends of the carton, the other half generally corresponding, FIG. 8 similarly shows one half only of the part of the apparatus which effects the folding down of the peripheral flange along the sides of the carton, the other half generally corresponding, FIG. 9 is a further enlarged view showing the part of the apparatus which completes the formation of the peripheral flange by heat-sealing, as seen looking upstream of the carton path, FIG. 10 is a plan view to an enlarged scale showing a further part of the apparatus by which the component parts of the flange are prepared for the subsequent formation of the carton side wall, and FIG. 11 shows in side elevation the part of the apparatus shown in FIG. 10.

Referring now to FIG. 1, a blank 10 for forming a rectangular tray-type packaging container for a food product is cut and creased from cardboard which is provided on one surface, that is to say, the surface which is to form the interior of the carton, with an overall coating of a polyester resin such as polyethylene terephthalate. The coating, which is heat-resistant, is not shown in the drawing but will be understood to be located on the surface which is visible to the reader. In known manner it is heat-sealable to itself under conditions of heat and pressure.

The blank 10 is generally rectangular and is internally sub-divided by crease lines to form it with a rectangular base panel 12, four side wall panels 14 disposed at the four sides of the base panel, partitioned gusset panels 16 at the corners of the blank and joining adjacent side wall panels 14 integrally together, and elongate panels 18, 181 carried individually by the side wall panels around the periphery of the blank and having projecting tabs 20, 201 at their ends. One of the tabs 201 is enlarged in width and length as shown at 202. In the erected carton 110 (FIG. 2) the base panel 12 forms the carton base 22, the side wall panels 14 form the carton side wall 24, the parts 16A, 16B of the gusset panels 16 are folded against one another to form gusset folds 26 which are disposed and secured against the side wall 24, and the elongate panels 18 form an outturned, horizontal flange 28 which extends continuously around the carton, with a projecting tab 281. After the carton has been filled with product the flange 28 provides a convenient surface on to which a closure lid having a projecting tab corresponding to tab 281 may be attached. The tabs facilitate removal of the lid by the purchaser when the container is to be opened.

It will be seen in FIGS. 1 and 2 that the side wall is made upwardly and outwardly tapering by suitable inclination of the crease lines defining the ends of its side wall panels 14, and the gusset folds 26 are secured against the side wall at tab portions 30 of the parts 16A of the gusset panels 16, which are brought into contact with the side wall when the gusset folds are formed and which are subsequently heat-sealed to the side wall. Furthermore, it should be noted that the tabs 20 are overlapped in pairs at the corners of the carton and heat-sealed together to form the continuous flange 28, the uppermost ones of the tabs being each provided by the elongate panels 18 of two opposed side wall panels 14. The significance of this will become apparent from the description which follows. In order to differentiate the uppermost tabs from the tabs beneath them the reference numeral 20 denoting the uppermost tabs is shown as 201, while the reference numeral 18 of the elongate panels which carry them is shown as 181.

Referring now to FIGS. 3, 4 and 5, the apparatus for erecting the blank 10 of FIG. 1 to form the tray-type carton 110 of FIG. 2 is diagrammatically shown to comprise a horizontal conveyor 40 which is operable intermittently by a variable speed braked motor 42 so as to move from left to right as shown in FIGS. 3 and 4. The conveyor has pockets 43 (FIG. 5) in which cartons received on the conveyor from a punch and die arrangement 44 may be snugly located and indexed through the two parts 46A, 46B of a flange forming station 46 and, subsequently, through a flange sealing station 48. After passing through the station 48 they are as depicted in FIG. 2, and ready for product filling and subsequent lidding.

The punch and die arrangement 44 may be largely conventional and as described, for example, in our U.K. Patent Specification No. 1187258. Briefly described, it has a vertically acting punch 50 by which blanks 10 taken one-by-one from a stack on a table 51 are forced through a rectangular aperture die 45 which forms up the side wall panels 14 in side wall forming position and at the same time forms the gusset folds from the panels 16 and heat seals them to the side wall by means of the tab portions 30. To that end the die has apertures (not shown) fed from heat exchangers 52 and arranged, as the blank is passing through the die, to direct hot gas on to the tab portions 30 and the parts of the side wall to which the tab portions are required to be heat-sealed. Pressure briefly exerted by the die on the gusset folds thereafter causes the gusset folds to adhere to the carton side wall.

On emerging from the punch and die arrangement 44 each carton is as shown in FIG. 2 but with its elongate panels 18 still coplanar with the side wall panels 14 to which they are attached. Such partly erected cartons are denoted by the reference number 111. FIG. 6A diagrammatically shows the carton in cross-section at this time. For ease of understanding the creases which separate the elongate panels 18 from the side wall 24 are exaggerated in size and denoted by the reference numeral 54.

Each carton in turn emerges from the bottom of the punch and die arrangement 44 and is received in a respective pocket 43 of the conveyor 40. The conveyor then indexes it through the first part 46A of the flange forming station of which the arrangement is shown in FIG. 7, through the second part 46B of the flange forming station which is shown in FIG. 8, and thence through the flange sealing station 48 which is shown in FIG. 9.

The first part 46A of the flange forming station is arranged to fold the elongate panels 18 at the leading and trailing ends of the carton outwardly and downwardly s that they adopt the substantially horizontal attitude depicted in FIG. 6D. To achieve this it firstly folds the panels substantially to a horizontal attitude (FIG. 6B) and then folds it further to a downwardly inclined attitude (FIG. 6C). Remanent resilience of the carton material at the creases 54 then causes the elongate panels 18 to spring back to the substantially horizontal attitude of FIG. 6D for the next operation.

Referring now to FIG. 7, the part 46A of the flange forming station has a central vertical shaft 60 to the bottom end of which is attached a clamping plate 62 dimensioned and arranged to engage and clamp the carton base 22 against an underlying surface (not shown). The shaft is biassed downwardly by a compression spring 64 in relation to an actuating assembly 66 which is vertically reciprocable by an actuator (not shown). A plate 68 fast with the actuating assembly 66 carries pins 70 to effect the folding of the elongate panels 18 at the ends of the partly erected carton 111 from the position of FIG. 6B to that of FIG. 6C.

Folding of the panels from the position shown in FIG. 6A to that of FIG. 6B is achieved by former members 72 having inclined bottom faces 74 and which are carried on a second plate 76 below the plate 68. The former members 72 have openings through which the pins may move. The plate 76 is biassed downwardly in relation to the actuating assembly 66 by compression springs 78 sleeved on studs 80.

Guide rods (not shown) having their bottom ends fast with the clamping plate 62 extend as a sliding fit through apertures in the plates 68, 76, so as to ensure correct vertical alignment of the items 62, 68 and 76 at all times.

In operation of the device of FIG. 7, a carton 111 is presented by the conveyor 40 when the actuating assembly 66 is raised. Lowering of the actuating assembly then brings the clamping plate 62 into clamping engagement with the carton base, after which further downward movement is accompanied by compression of the spring 64 until the former members 72 engage the free top edges of the elongate panels 18 at the ends of the carton and cause those elongate panels progressively to fold outwardly about the creases 54. At about the time that the panels 18 have been moved to the approximately horizontal position of FIG. 6B, the assembly carrying the plate 76 engages a stop 82, following which the folding down of the elongate panels to the position 6C is taken over by the pins 70 with continued movement of the actuator assembly 66 to the bottom of its stroke. The actuator assembly then reverses its movement to free the carton for movement to the device 46B; by so doing it allows the elongate panels to relax to the substantially horizontal attitude shown in FIG. 6D.

As seen in FIG. 8, the second part 46B of the flange forming station is similar in many respects to the part 46A and like reference numerals are used to indicate like parts. Like the part 46A, the part 46B has a vertically reciprocable actuator assembly 66 having a plate 68 carrying pins 70, a shaft 60 carrying a clamping plate 62 for the carton base at its bottom end and biassed downwardly in relation to the actuator assembly by a compression spring 64, and a further plate 76 below the plate 68 and carrying former members 72 (not shown) with inclined bottom faces. The former members 72 and pins 70 perform the same flange-folding function and in the same manner as described in relation to the FIG. 7, except that they are located to engage the elongate panels 18 along the sides rather than the ends of the carton. Whereas, however, in FIG. 7 the plate 76 carrying the former members 72 is resiliently mounted in relation to the actuating assembly 66 and the shaft 60 with clamping plate 62, in FIG. 8 the plate 76 is fast with the shaft and clamping plate. The reason for this simplified arrangement is that whereas in FIG. 7 no vertical control for the carton is available except that provided by the clamping plate 62, and it is therefore important that the clamping plate should be effective during the whole of the operation to fold down the flange at the ends of the carton, in FIG. 8 top loading is available from a pair of control bars 83 which extend along and above the conveyor and are resiliently mounted to engage the carton at the folded elongate panels 18 of its leading and trailing ends.

In addition to the control bars 82, additional control of the carton during the folding of its panels 18 is provided by the pockets 43 which engage the exterior of the side wall panels 14 along the sides and ends of the carton. The pockets provide folding edges 45 located just below the level of the crease lines 54 and over which the elongate panels can be folded by the parts 46A and 46B of the flange forming station.

The carton leaves the flange folding station with its elongate panels 18 substantially horizontal and with the tabs 20 overlapped in pairs at the corners of the carton. For the reason shortly to become apparent the uppermost one 201 of the tabs has an upward inclination so as to form an acute angle of, typically, 45° with the lowermost tab of the pair; the latter tab 20 still remains in the plane of the elongate panel 18 which carries it, and is therefore substantially horizontal. The uppermost tabs 201 are carried at the ends of the carton, and the recesses which they form with the underlying tabs 20 are therefore directed towards the sides to the carton where they are accessible to the hot air of the flange sealing station 48.

Referring now to FIG. 9, the apparatus forming the heat sealing station has a vertically reciprocable clamping assembly 90 with four spring-mounted posts 92 disposed to apply vertical pressure to the pairs of tabs 20 when the clamping assembly is lowered. Also provided are four nozzles 93 supplied with hot air from a heat exchanger 94 and disposed to direct the hot air into the recesses formed by the tabs. A carton 111 indexed beneath the clamping assembly thus has the opposed surfaces of its pairs of tabs 20 heated by the hot air to a temperature at which the polyester coating on the carton is heat sealable, after which the assembly 90 is lowered by an actuator 98 so as to adhere the tabs together and complete the continuous peripheral flange 28 (FIG. 2). The assembly 90 is then raised, and the carton continues on the conveyor 40 for subsequent filling and lidding. During sealing the posts 92 act against anvils 99 to generate the pressure required for heat-sealing.

The formation of the side wall 24 in the punch and die arrangement 44 involves the folding of the side wall panels 14 towards one another as they move into their required end-to-end positions. At this time the elongate panels 18 are still in coplanar relation with the side wall panels (as seen in FIG. 6A), so that, unless precautions are taken, the tabs 20 at each corner of the carton will come into engagement with one another and will be indiscriminently folded or crumpled as the wall panels converge. If this is allowed to occur the folding of the panels 18 in the flange forming station 46 will not necessarily result in the correct positioning of the tabs 20 in relation to one another for hot air sealing in the station 48. FIGS. 10 and 11 show a device which is located vertically above the die of the punch and die arrangement 44 and by which the uppermost tabs 201 are folded upwards out of the plane of the blank before the blank enters the die of the punch and die arrangement. This prefolding ensures that during the formation of the side wall and the subsequent folding of the elongate panels 18, the prefolded tabs are always so positioned in relation to the other tabs 20 and their associated elongate panels 18 that they reliably adopt the required uptilted, uppermost positions required for heat-sealing as described above in relation to FIG. 9.

Referring to FIGS. 10 and 11, the prefolding device has a rectangular frame 102 which has an aperture 104 down and through which the carton blank is carried by the punch 50 on its way to the die 45 of the punch and die arrangement 44. The punch 50 is visible in FIG. 10 as its shaft 130, the head of the punch not being shown.

A cam 106 fast with the punch has an associated follower 108 acting through a linkage 109 by which two cross shafts 112 may be rotated through a small angle.

The cross shafts 112 carry fingers 114 (seen also in FIG. 3) the free ends of which are located to underlie the tabs 201 of the blank passing through the frame 102. The arrangement is such that as the punch so descends and engages the base of the blank and is about to force it down through the die 45, the fingers 114 are lifted to fold the tabs 201 upwardly in relation to the remainder of the blank. The permanent upward inclination thereby given to the tabs ensures that the tabs are in the required position for heat-sealing at the flange sealing station 48, as previously mentioned. In order to localise the folding of the blank caused by the fingers 114 to the tabs 20, crease lines 120 are provided in the blank as shown in FIG. 1, and restraint bars 122 having upper and lower members 124, 126 are attached to the frame 102. The restraint bars have openings 128 through which the free ends of the fingers and the tabs 201 being folded by them may move.

In modification of the described apparatus the flange forming station 46 has only one part arranged to fold down the elongate panels 18 both along the sides and along the ends of the carton.

I claim:

1. A method of erecting from a blank of foldable sheet material a rectangular tray-type carton having a base formed from a base panel of the blank, a side wall upstanding from the base and formed from four side wall panels, gusset folds secured against the side wall at the corners of the carton and formed from gusset panels by which the side wall panels are joined integrally together, and a continuous peripheral flange outturned from the side wall around the mouth of the carton, the flange being formed from elongate panels carried by the side wall panels and formed at their ends with tabs which are secured together in overlapping relation at the corners of the carton, wherein the method is characterised by the steps of:

(a) prior to folding up the side wall panels, folding up from the plane of the blank those of the tabs which are to be uppermost in the erected carton, (b) at a first station, forming the side wall by folding up the side wall panels in relation to the base panel whilst folding the gusset panels to form the gusset folds, such folding being accompanied by movement of the elongate panels wth the side wall panels as coplanar extensions thereof with the exception of the said uppermost ones of the tabs, (c) moving the partially erected carton from the first station to a second station;

(d) at the second station, folding the elongate panels outwardly in relation to the side wall and into generally coplanar relation with one another, with the said uppermost tabs overlying other ones of the tabs at the corners of the carton, and (e) securing the overlapping tabs together at the corners of the carton to form the continuous peripheral flange.

2. A method according to claim 1 characterised by, in step (a), restraining the base of the blank against upward movement while engaging the tabs which are to be uppermost by pivoted fingers and lifting said fingers to fold the tabs upwardly.

3. A method according to claim 2 characterised by restraining the base of the blank in step (a) by a punch and subsequently in step (b) forcing the blank through a die by means of said punch to effect the folding of the side wall panels.

4. A method according to claim 1, characterised in that the elongate panels at leading and trailing ends of the carton are first folded at a first part of the second station and the elongate panels at the sides of the carton are subsequently folded at a second part of the second station.

5. A method according to claim 4 characterised in that the folding of the elongate panels is effected in two stages, by first folding them to a substantially horizontal attitude and then by further folding them to a downwardly inclined attitude from which the resilience of the carton material causes them to spring back to the substantially horizontal attitude.

6. A method according to any one of the preceding claims characterised in that the overlapping tabs are secured by pressing down the uppermost tabs on to the lowermost tabs by means of vertically reciprocable spring-mounted posts.

7. Apparatus for erecting a blank of foldable sheet material into a rectangular tray-type carton having a base formed from a base panel of the blank, a side wall upstanding from the base and formed from four side wall panels, gusset folds secured against the side wall at the corners of the carton and formed from gusset panels by which the side wall panels are joined integrally together, and a continuous peripheral flange outturned from the side wall around the mouth of the carton, the flange being formed from elongate panels carried by the side wall panels and formed at their ends with tabs which are secured together in overlapping relation at the corners of the carton, wherein the apparatus is characterized by:

(a) a first station incorporating a punch, a die, means for moving said punch into co-operating relationship with said die for folding up said side wall panels, operating means operatively connected to said punch and operated by movement of said punch and pivotal fingers operatively connected to said operating means and arranged to be operated prior to folding up the side wall panels by said operating means on movement of the punch towards the die so as to fold up from the plane of the blank those of the tabs which are to be uppermost in the erected carton, the punch and die being arranged to co-operate to form the side wall by folding up the side wall panels in relation to the base panel whilst folding the gusset panels to form the gusset folds, such folding being accompanied by movement of the elongate panels with the side wall panels as coplanar extensions thereof with the exception of the said uppermost ones of the tabs, (b) a second station incorporating folding means for folding the elongate panels outwardly in relation to the side wall so as to form the peripheral flange and to bring the tabs into overlapping relationship at the corners of the carton, (c) a third station incorporating sealing means for bonding the overlapping tabs together to complete the peripheral flange, and (d) a conveyor arranged to run past the first, second, and third stations and operable to receive the partially erected carton from the first station and to transport it to the second and third stations.

8. Apparatus according to claim 7 characterised in that the operating means comprises a cam connected to the punch and a cam follower linked to the pivotal fingers.

9. Apparatus according to claim 7 or 8 characterised in that intermittent drive means is provided for driving the conveyor to index the cartons through the second and third stations.

10. Apparatus according to claim 7, wherein said folding means comprises two parts operable sequentially, first on the leading and trailing edges and then on the sides of the carton.

11. Apparatus according to claim 7, characterised in that the folding means comprises a vertically reciprocable actuating assembly carrying spring-mounted former members operable to effect a first folding and vertical pins movable through apertures in the former members and operable to effect a further folding of the elongate panels.

12. Apparatus according to claim 7, characterised in that the sealing means at the third station comprises a vertically reciprocable clamping assembly having spring-mounted posts operable to apply vertical pressure to the pairs of tabs and nozzles positioned to direct hot air on the tabs before they are pressed together by the posts.

* * * * *